US010638231B2

(12) United States Patent
Wang et al.

(10) Patent No.: US 10,638,231 B2
(45) Date of Patent: Apr. 28, 2020

(54) DIAPHRAGM STRUCTURE FOR LOUDSPEAKER

(71) Applicant: Tymphany Acoustic Technology (Huizhou) Co., Ltd., Huizhou, Guangdong Province (CN)

(72) Inventors: Zheng Min Wang, Huizhou (CN); Zhi Chen, Huizhou (CN)

(73) Assignee: TYMPHANY ACOUSTIC TECHNOLOGY (HUIZHOU) CO., LTD., Huizhou, Guangdong Prov. (CN)

( * ) Notice: Subject to any disclaimer, the term of this patent is extended or adjusted under 35 U.S.C. 154(b) by 0 days.

(21) Appl. No.: 16/386,662

(22) Filed: Apr. 17, 2019

(65) Prior Publication Data

US 2019/0379979 A1 Dec. 12, 2019

Related U.S. Application Data

(60) Provisional application No. 62/681,399, filed on Jun. 6, 2018.

(51) Int. Cl.

| | |
|---|---|
| ***H04R 7/06*** | (2006.01) |
| ***H04R 9/00*** | (2006.01) |
| ***H04R 7/00*** | (2006.01) |
| ***H04R 7/14*** | (2006.01) |
| ***H04R 31/00*** | (2006.01) |

(52) U.S. Cl.

CPC ..... *H04R 7/14* (2013.01); *H04R 31/003* (2013.01); *H04R 2307/027* (2013.01)

(58) Field of Classification Search

CPC ..... H04R 9/00; H04R 7/00; H04R 2207/00; H04R 7/06

USPC ..... 381/396, 423–424

See application file for complete search history.

(56) References Cited

U.S. PATENT DOCUMENTS

| | | | | |
|---|---|---|---|---|
| 4,321,434 A * | 3/1982 | Irie | H04R 7/14 381/423 |
| 6,039,146 A * | 3/2000 | Byun | H04R 31/003 181/169 |
| 9,148,727 B1 * | 9/2015 | Busenitz | H04R 7/02 |

* cited by examiner

*Primary Examiner* — Suhan Ni

(74) *Attorney, Agent, or Firm* — Muncy, Geissler, Olds & Lowe, P.C.

(57) ABSTRACT

This disclosure provides a diaphragm structure of a loudspeaker, including a surround and an annular body. The surround is annular and has an inner rim and an outer rim relative to the inner rim. The annular body disposed on the inner rim of the surround is integrally formed by a plurality of rigid reinforcing units arranged in a circle. Each rigid reinforcing unit includes a first side edge, a second side edge, and two third side edges connected to the first side edge and the second side edge. The two third side edges are formed by a plurality of first reference points at different height positions, and heights of the first reference points asymmetrically and gradually decrease from the middle towards the first side edge and the second side edge to form a substantially upward curve. A peak ridge line is defined between first reference points at the highest position of the two third side edges located on the opposite sides, and the peak ridge line is formed by a plurality of second reference points at different height positions, and heights of the second reference points symmetrically and gradually increase from the middle towards the two third side edges to form a substantially downward curve.

11 Claims, 7 Drawing Sheets

DIAPHRAGM STRUCTURE FOR LOUDSPEAKER

BACKGROUND

Technical Field

This disclosure relates to a diaphragm structure, and in particular to a diaphragm structure of a loudspeaker.

Related Art

A loudspeaker is a transducer converting electric energy into sound energy. The sound energy generates sound to the surrounding in the form of radiation of sound waves, and the radiation of sound waves is mainly achieved by a diaphragm driving surrounding air media. A diaphragm is an important component of a loudspeaker, and generally includes an annular body and a surround disposed on an outer rim of the annular body.

Referring to FIG. 11, a traditional diaphragm 2 mostly has a uniform curvature along an outward extension direction of a traditional annular body 40. And, a traditional surround 50 extends outward along an outer rim of the annular body 40. As a result, a height of a loudspeaker with the annular body is too large to meet the requirements of a lightweight assembly.

In addition, high-power loudspeakers often have larger vibration, and while the strength of the traditional diaphragm is sometimes insufficient to resist the vibration. Therefore, it is necessary to develop a diaphragm with high strength.

SUMMARY

In view of this, this disclosure provides a diaphragm structure of a loudspeaker, including a surround and an annular body. The surround is annular and has an inner rim and an outer rim relative to the inner rim. The annular body disposed on the inner rim of the surround is integrally formed by a plurality of rigid reinforcing units arranged in a circle. Each rigid reinforcing unit includes a first side edge, a second side edge, and two third side edges connected to the first side edge and the second side edge. The two third side edges are located on opposite sides, and the first side edge and the second side edge are separately located on opposite sides. The two third side edges are formed by a plurality of first reference points at different height positions, and heights of the first reference points asymmetrically and gradually decrease from the middle towards the first side edge and the second side edge to form a substantially upward curve. A peak ridge line is defined between first reference points at the highest position of the two third side edges located on the opposite sides, and the peak ridge line is formed by a plurality of second reference points at different height positions, and heights of the second reference points symmetrically and gradually increase from the middle towards the two third side edges to form a substantially downward curve. All first side edges of the plurality of rigid reinforcing units at the same height position form an inner circle of the annular body, and all second side edges at the same height position form an outer circle of the annular body.

In an embodiment, the first reference points of the highest height position at the two third side edges are at the same height position.

In an embodiment, a plurality of normal lines is defined at positions perpendicular to the peak ridge line between the first side edge and the second side edge, and a curvature of each of the third side edges is greater than or equal to a curvature of each of the normal lines.

In an embodiment, the highest positions of the normal lines are intersections of the normal lines and the peak ridge line.

In an embodiment, each of the normal lines is formed by a plurality of third reference points at a plurality of different height positions, a normal line passing the lowest position of the peak ridge line is defined as a reference normal line, and a third reference point at the highest position of the reference normal line is a second reference point at the lowest position of the peak ridge line.

In an embodiment, each of the rigid reinforcing units comprises a first surface and a second surface connected to the first surface; the first surface is between the peak ridge line and the first side edge and between the two third side edges, and the second surface is between the peak ridge line and the second side edge and between the two third side edges, where a bent portion is formed between the first surface and the second surface.

In an embodiment, the height position of the second side edge is higher than a height position of the first side edge.

In an embodiment, the material of the annular body is aluminum. The aluminum material of the annular body has a density of 2700 kg/m$^3$. The aluminum material of the annular body has a Young's modulus of 75 GPa. The aluminum material of the annular body has a Poisson's ratio of 0.33.

In summary, in the diaphragm structure of the loudspeaker according to this disclosure, positions of the first reference points of the third side edges gradually decrease from the highest point (the first reference points at the highest height position in the third side edges) towards a direction of the first side edge and a direction of the second edge; height positions of the second reference points of the peak ridge line gradually increase from the lowest point (the first reference points at the lowest height position of the peak ridge line) towards directions of the highest points at both ends (the first reference points at the highest position). Thus, each rigid reinforcing unit forms a bent portion between the first surface and the second surface (at the peak ridge line), and forms a downward curve and presents a saddle shape at the peak ridge line, and the rigid reinforcing units of the diaphragm structure can solve the stress concentration problem between the first surface and the second surface (at the peak ridge line) so as to improve the strength of the rigid reinforcing units and enhance vibration energy of the diaphragm, thereby effectively improving sensitivity of the loudspeaker and extending a service life of the diaphragm structure.

BRIEF DESCRIPTION OF THE DRAWINGS

The present invention will become more fully understood from the detailed description given herein below for illustration only, and thus are not limitative of the present invention, and wherein.

DETAILED DESCRIPTION

Figure 1:
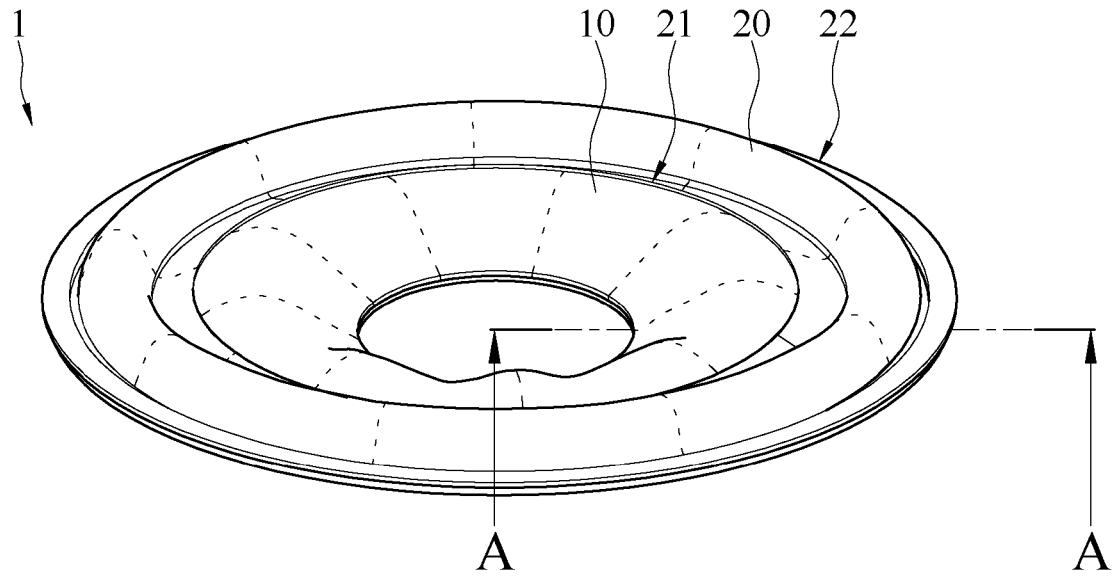
FIG. 1 is a schematic three-dimensional diagram of an embodiment of a diaphragm structure of a loudspeaker according to this disclosure.
Figure 2:
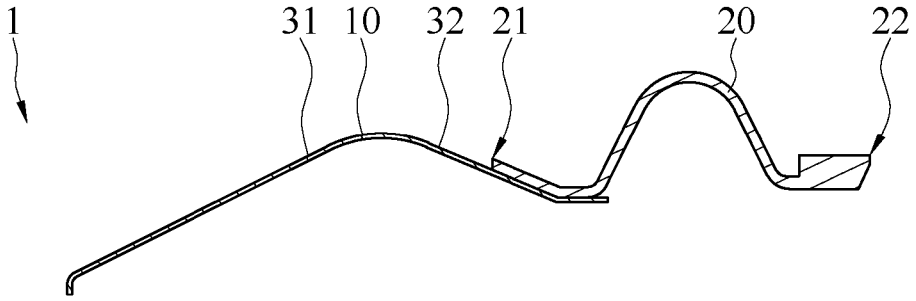
FIG. 2 is a schematic cross-sectional view of FIG. 1 along an A-A section line.

Referring to FIG. 1 and FIG. 2, this disclosure provides a diaphragm structure 1 of a loudspeaker. In this embodiment, the diaphragm structure 1 includes an annular body 10 and a surround 20. The surround 20 is annular and has an inner rim 21 and an outer rim 22. The annular body 10 is disposed on the inner rim 21 of the surround 20.

Figure 3:
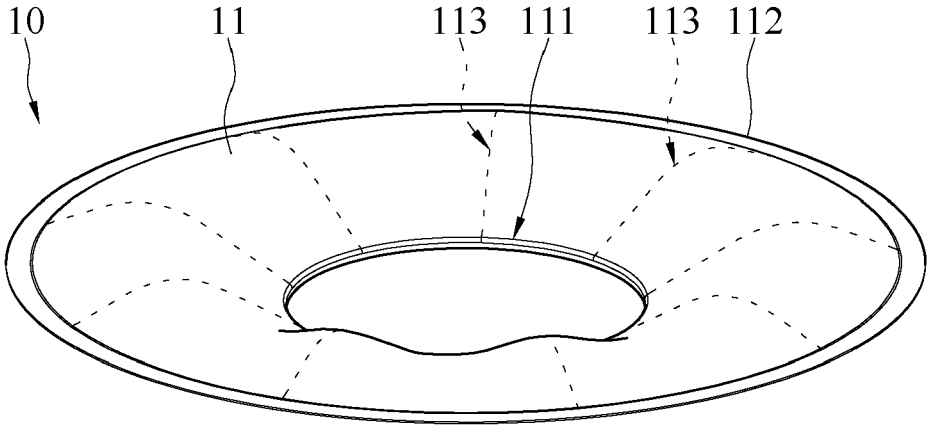
FIG. 3 is a schematic three-dimensional diagram of an embodiment of an annular body according to this disclosure.
Figure 4:
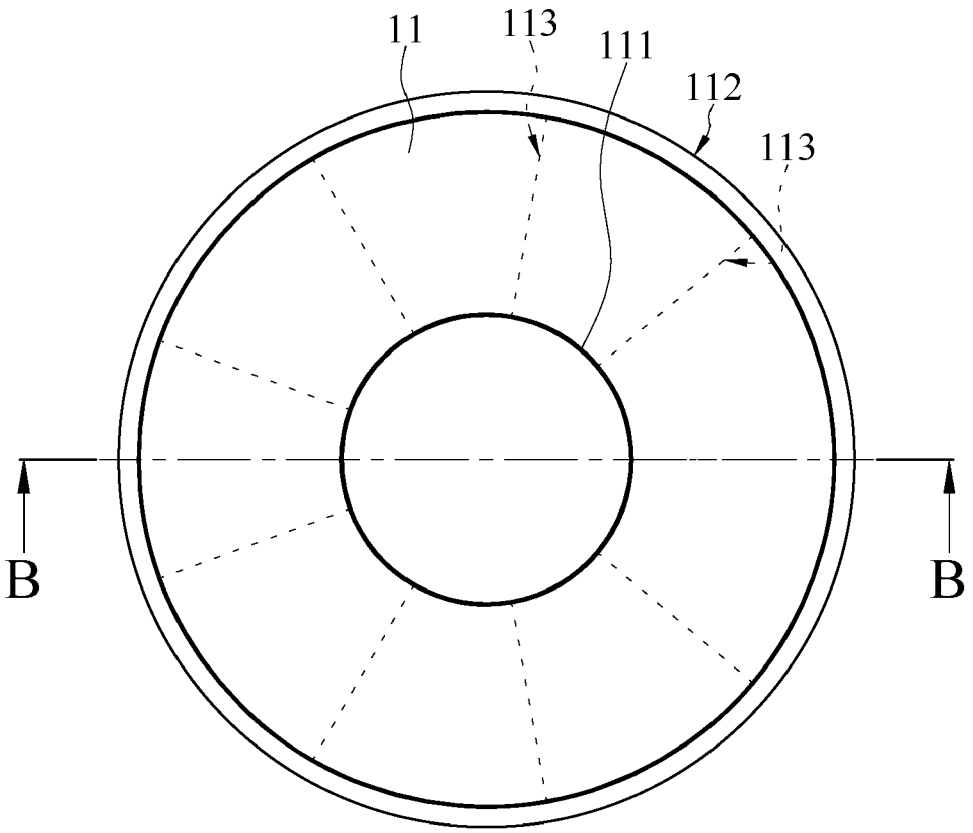
FIG. 4 is a top view of an embodiment of an annular body according to this disclosure.
Figure 5:
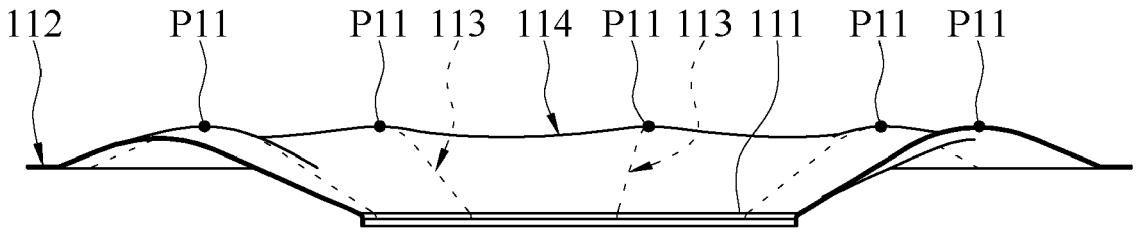
FIG. 5 is a schematic radial cross-sectional view of FIG. 4 along a B-B section line.

Referring to FIG. 3, FIG. 4 and FIG. 5, the annular body 10 is integrally formed by a plurality of rigid reinforcing units 11 arranged in a circle. Each rigid reinforcing unit 11 has a first side edge 111, a second side edge 112 opposite to the first side edge 111 and two opposite third side edges 113 connected to the first side edge 111 and the second side edge 112. The first side edges 111 of the rigid reinforcing units 11 are at the same height position and form a circle. In other words, the first side edges 111 of the rigid reinforcing units 11 are sequentially connected to form an inner circumference of a ring. The second side edges 112 of the rigid reinforcing units 11 are at the same height position and form a circle. In other words, the second side edges 112 of the rigid reinforcing units 11 are sequentially connected to form an outer circumference of the ring. The outer circumference of each rigid reinforcing unit 11 is longer than the inner circumference thereof In this way, a length of each second side edge 112 is greater than a length of each first side edge 111.

The surround 20 is disposed on an outer circumference of the annular body 10. In some embodiments, as shown in FIG. 1, the inner rim 21 of the surround 20 is between an inner circumference and the outer circumference of the annular body 10. Any third side edge 113 of each rigid reinforcing unit 11 is also a third side edge 113 of the neighboring rigid reinforcing unit 11. The third side edges 113 are defined herein only for ease of description. In fact, a plurality of rigid reinforcing units 11 is arranged in a circle to form an integral body. Since the size of the annular body affects sound transmission efficiency and a sound pressure level (SPL) curve, the number of the rigid reinforcing units 11 can be determined according to requirements of the loudspeaker. In some embodiments, the number of the rigid reinforcing units 11 is an odd number. For example, as shown in FIG. 1, the annular body 10 is formed by nine rigid reinforcing units 11 arranged in a circle. However, in other embodiments, the annular body 10 may also be formed by an even number of rigid reinforcing units 11 arranged in a circle, which is not limited by this embodiment.

Figure 6:
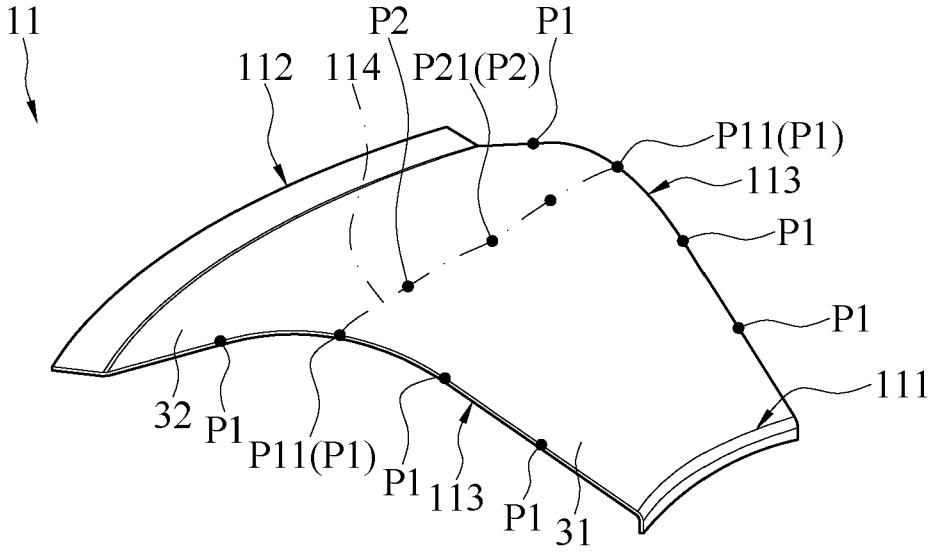
FIG. 6 is a schematic three-dimensional diagram of an embodiment of a rigid reinforcing unit according to this disclosure.

Referring to FIG. 6, for a single rigid reinforcing unit 11, each third side edge 113 is arc-shaped. Each third side edge 113 can be defined as a connecting line of a plurality of first reference points P1 at a plurality of different height positions (for ease of description, positions and numbers of the first reference points P1 shown in FIG. 6 are only illustrative). For ease of description, first reference points at the highest height position in the third side edges 113 are labeled as P11. Height positions of the first reference points P1 of each third side edge 113 gradually decrease from the first reference points P11 at the highest height position in the third side edge 113 towards a direction of the first side edge 111 and a direction of the second side edge 112. In other words, in FIG. 6, a cross section of each rigid reinforcing unit 11 along the third side edges 113 is an upward curve, and only P1 is the highest, while height positions of other first reference points P1 are lower than the height positions of P11.

Figure 7:
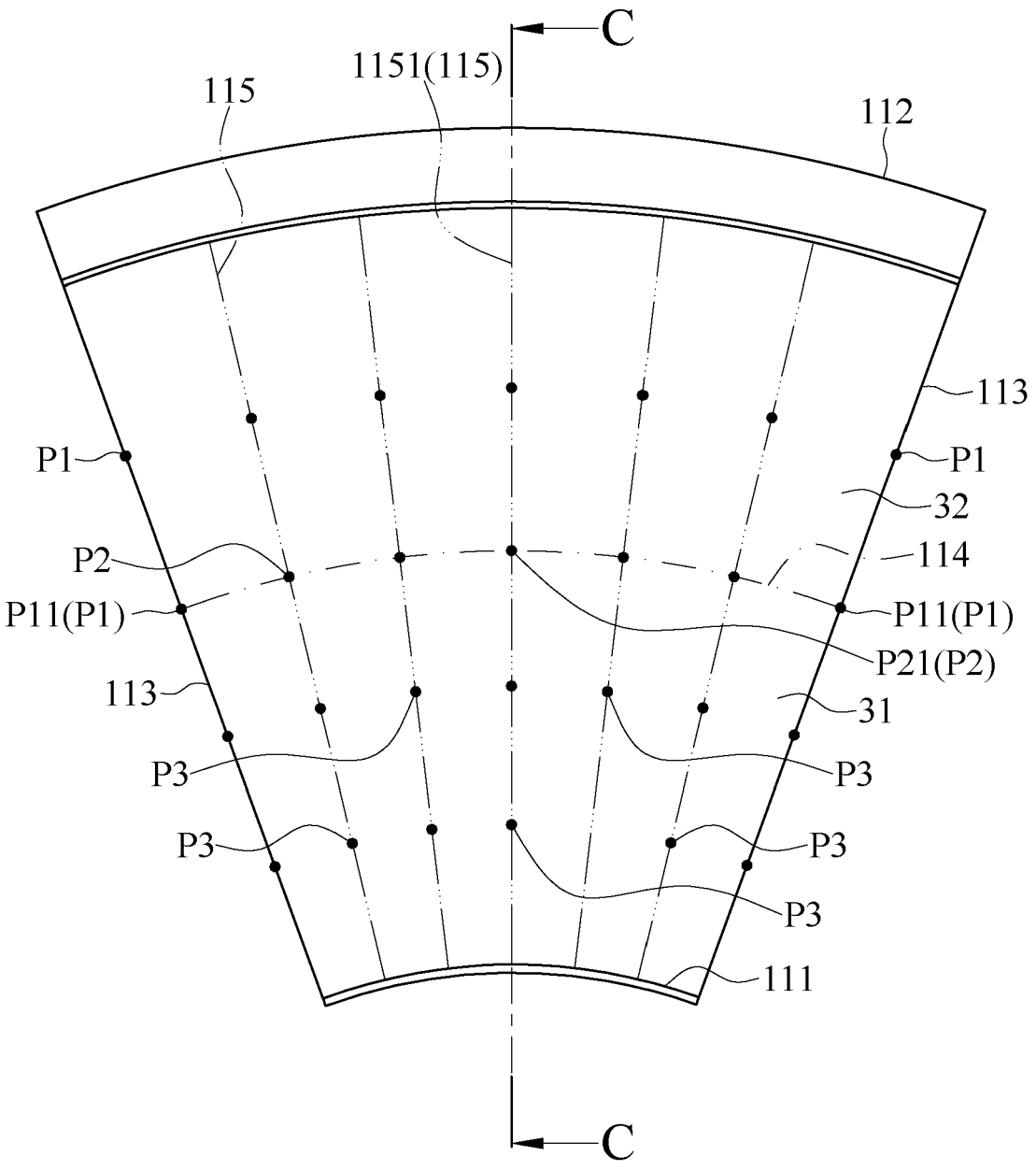
FIG. 7 is a top view of an embodiment of a rigid reinforcing unit according to this disclosure.

As shown in FIG. 4, which is a top view, the inner and outer circumferences of the annular body 10 actually form concentric circles that are parallel to each other. Refer to FIG. 7, which is a top view of a rigid reinforcing unit 11. A peak ridge line 114 (indicated by a dotted line) is defined by a connecting line between the highest first reference points P11 of the third side edges 113 on both sides of the rigid reinforcing unit 11, and the peak ridge line 114 is also parallel to the inner and outer circumferences of the annular body 10. A plurality of normal lines 115 may be defined perpendicular to a direction of the peak ridge line 114 (for ease of description, the normal lines 115 shown in FIG. 7 are indicated by broken lines), and the peak ridge line 114 can be formed by connecting the highest points of the normal lines 115 (as shown in FIG. 8).

Figure 8:
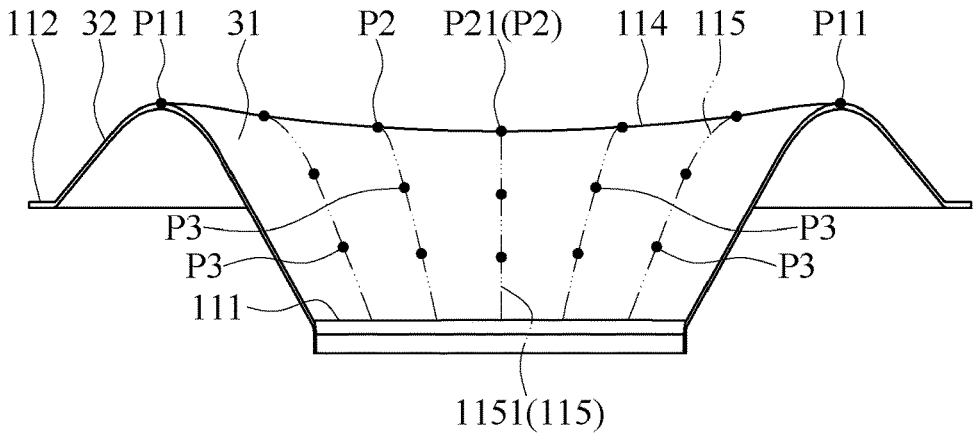
FIG. 8 is a schematic three-dimensional diagram of an embodiment of a rigid reinforcing unit according to this disclosure.

Referring to FIG. 8, the peak ridge line 114 is formed by a plurality of second reference points P2 at different height positions, where the lowest second reference point P2 of the peak ridge line 114 is labeled as P21. A height position of the peak ridge line 114 gradually increases from the lowest second reference point P21 towards directions of the highest first reference points P11 at both ends. In other words, in FIG. 8, the peak ridge line 114 of each rigid reinforcing unit 11 is a downward curve, and height positions of other second reference points P2 are higher than the height position of P21. In addition, in FIG. 5, the peak ridge lines 114 of the rigid reinforcing units 11 are sequentially connected to form a plurality of continuously undulating downward curves.

In some embodiments, referring to FIG. 8, for the same rigid reinforcing unit 11, the first reference points P11 at the highest height position of the two opposite third side edges 113 and two end points of the peak ridge line 114 are actually the same points, and the peak ridge line 114 is centered at the lowest point P21 and is in bilateral symmetry.

Figure 9:
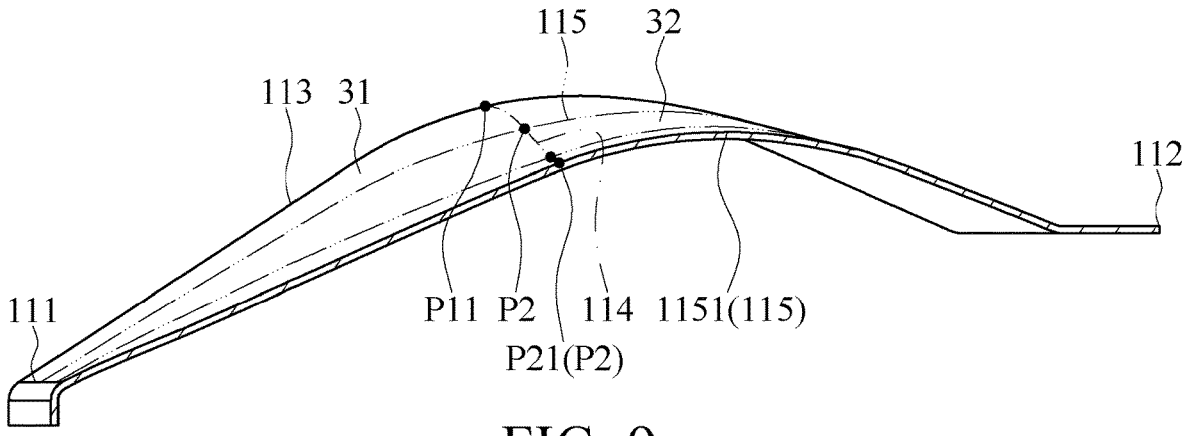
FIG. 9 is a schematic cross-sectional view of FIG. 7 along a C-C section line.

Each normal line is perpendicular to a peak ridge line, and each normal line is defined by a connecting line between one point of the first side edge and one point of the second side edge, where the connecting line is perpendicular to the peak ridge line and passes one of the second reference points. The normal lines 115 are formed by a plurality of third reference points P3 at different height positions (positions and numbers of the third reference points P3 shown in FIG. 7 and FIG. 8 are only illustrative). Because each normal line 115 passes the peak ridge line 114, a third reference point P3 at the highest height position in the normal line 115 is the second reference point P2 of the peak ridge line 114. Height positions of the third reference points P3 of each normal line 115 gradually decreases from the second reference point P2 (the highest point of the normal line 115) intersecting with the peak ridge line 114 towards the direction of the first side edge 111 and the direction of the second side edge 112. That is to say, a cross section of each rigid reinforcing unit 11 along each normal line 115 is an upward curve. For example, with reference to an example of a reference normal line 1151, as shown in FIG. 9, which is a schematic cross-sectional view of FIG. 7 along the reference normal line 1151, the reference normal 1151 refers to a normal line passing the second reference point P21 at the lowest height position of the peak ridge line 114. That is to say, the reference normal line 1151 is a connecting line between a center point of the first side edge 111 and a center point of the second side edge 112, where the connecting line is perpendicular to the peak ridge line 114 and passes the second reference point P21 at the lowest height position of the peak ridge line 114. Similarly, height positions of the third reference points P3 of the reference normal line 1151 gradually decrease from the second reference point P2 (the second reference point 21 at the lowest height position of the peak ridge line 114) intersecting with the peak ridge line 114 towards the direction of the first side edge 111 and the direction of the second side edge 112. The third reference point P3 at the highest height position of the reference normal line 1151 is also the second reference point P21 at the lowest height position of the peak ridge line 114.

In some embodiments, referring to FIG. 9, the first side edge 111 of each rigid reinforcing unit 11 is at the same height position, and the second side edge 112 of each rigid reinforcing unit 11 is at the same height position. Each normal line 115 is a connecting line between one point of the first side edge 111 and one point of the second side edge 112, where the connecting line passes one of the second reference points P2, and height positions of the second reference points P2 of the peak ridge line 114 are different. Therefore, height positions of the third reference points P3 at the highest positions of the normal lines 115 are different. In this way, a curvature (degree of curving) of a normal line 115 closer to a third side edge 113 is greater than a curvature of a normal line 115 farther away from the third side edge 113. A curvature of the reference normal line 1151 is the smallest, and a curvature of each third side edge 113 is the largest.

In some embodiments, referring to FIG. 7, FIG. 8 and FIG. 9, each rigid reinforcing unit 11 has a first surface 31 and a second surface 32 connected to the first surface 31. The first surface 31 is an area between the two opposite third side edges 113 and between the peak ridge line 114 and the first side edge 111. The second surface 32 is between the two opposite third side edges 113 and between the peak ridge line 114 and the second side edge 112. A bent portion is formed between the first surface 31 and the second surface 32, while the surround 20 is adhered to a portion of the second surface 32. In this way, an overall height of the diaphragm structure 1 can be improved.

In some embodiments, referring to FIG. 9, a height position of each second side edge 112 is higher than a height position of each first side edge 111, that is, an outer circumference of the annular body 10 is higher than an inner circumference.

In addition, because the peak ridge line 114 is a downward curve, the bent portion between the first surface 31 and the second surface 32 need not be too sharp so as to solve the stress concentration problem between the first surface 31 and the second surface 32 (at the peak ridge line 114), thereby improving the strength of the rigid reinforcing unit 11. In some embodiments, each rigid reinforcing unit 11 substantially is a saddle shape. In some embodiments, the reference numeral P11 of each first reference point is at the highest height position in the rigid reinforcing unit 11.

The annular body 10 may be made of an aluminum material. Preferably, material parameters of the annular body 10 of this disclosure are shown in Table 1.

TABLE 1

| Material | Density(kg/m$^3$) | Young's modulus (GPa) | Poisson's ratio |
|---|---|---|---|
| Aluminum | 2700 | 75 | 0.33 |

Figure 11:
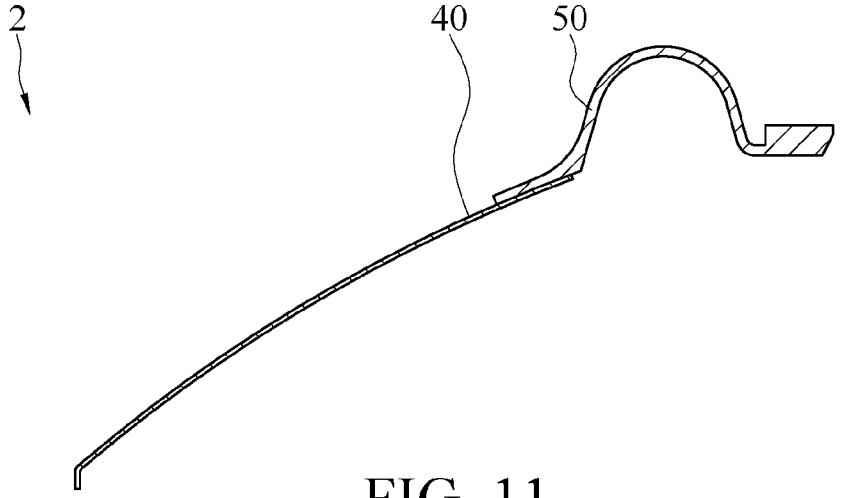
FIG. 11 (Prior Art)
FIG. 11 shows a diagram structure of the prior art.

A modal analysis is performed to compare the strength of the annular body 10 of this disclosure and a conventional annular body (without rigid reinforcing units) having a uniform curvature. First five natural frequencies of the annular body 10 of this disclosure and of the traditional annular body (shown in FIG. 11) are obtained, as shown in Table 2.

TABLE 2

| Modal Order | Natural Frequency of the Traditional Annular Body (Hz) | Natural Frequency of the Annular Body 10 of This disclosure (Hz) |
|---|---|---|
| 1 | 398.5 | 595.5 |
| 2 | 958 | 1267 |
| 3 | 1523 | 1849 |
| 4 | 1567 | 2501 |
| 5 | 2327 | 2633 |
| . . . | . . . | . . . |

As can be seen from Table 2, the first five natural frequencies of the annular body 10 of this disclosure are higher than the first five natural frequencies of the conventional annular body. According to the following formula (1):

$$f_n = \frac{1}{2\pi}\sqrt{\frac{K_n}{M_n}},\ n = 1, 2, 3, \ldots \tag{1}$$

where n is an order, $K_n$ is the $n^{th}$ modal stiffness, and $M_n$ is the $n^{th}$ modal mass, when the thickness is same, because a total area of the annular body 10 of this disclosure is larger than that of the conventional annular body, the mass of the annular body 10 of this disclosure is greater than that of the conventional annular body. According to the above formula (1), the stiffness of the annular body 10 of this disclosure is greater than that of the conventional annular body.

Figure 10:
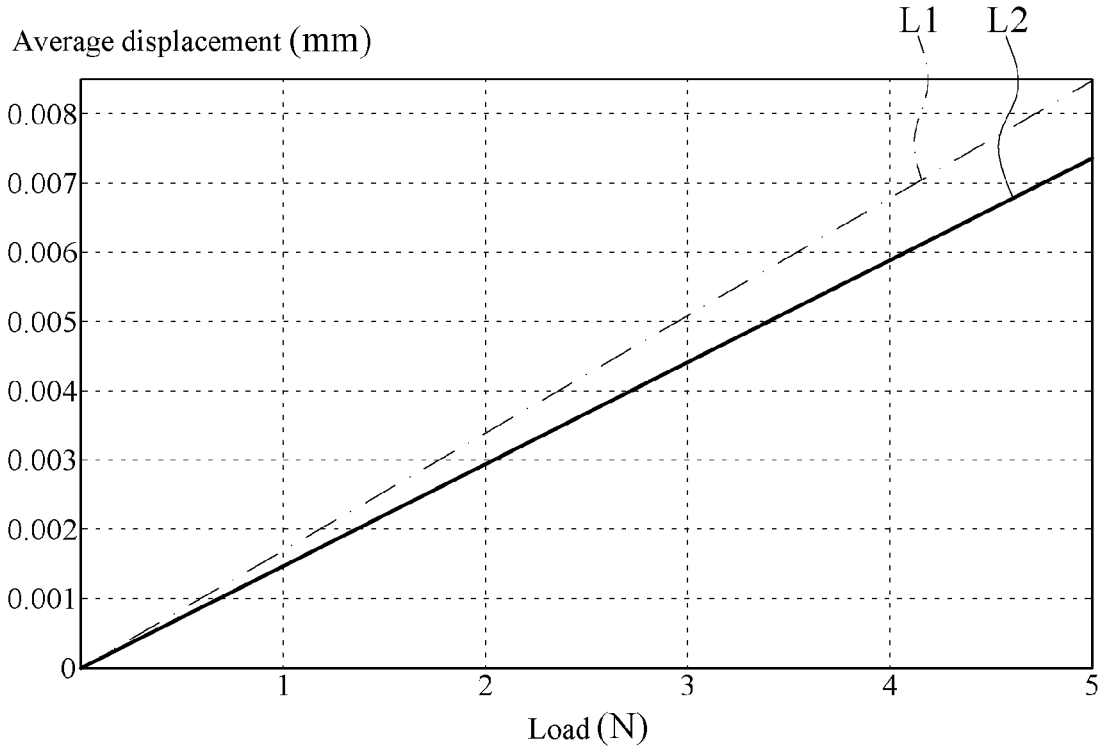
FIG. 10 is a load-displacement curve diagram of an embodiment of an annular body according to this disclosure.

Referring to FIG. 10, a load-displacement curve diagram generated by testing the annular body 10 is shown. A normal boundary load is applied to the first side edge 111 of the annular body 10, and a surface constraint boundary is added at the second side edge 112 of the annular body 10. An average displacement of an upper surface of the whole annular body 10 under the same load is calculated. In FIG. 10, the curve L1 is a load-displacement curve of a conventional annular body (without rigid reinforcing units) during operation, and the curve L2 is a load-displacement curve of the annular body 10 of this disclosure during operation. Comparing the curve L1 with the curve L2, it can be seen that the average displacement of the curve L2 of the annular body 10 of this disclosure is smaller than the average displacement of the curve L1 of the conventional annular body. Therefore, it can be seen that the stiffness of the annular body 10 of this disclosure is greater than that of the conventional annular body.

In summary, in the diaphragm structure of the loudspeaker according to this disclosure, height positions of the first reference points of the third side edges gradually decrease from the highest point (the first reference points at the highest height position in the third side edges) towards a direction of the first side edge and a direction of the second edge; height positions of the second reference points of the peak ridge line gradually increase from the lowest point (the first reference points at the lowest height position of the peak ridge line) towards directions of the highest points at both ends (the first reference points at the highest position). Thus, each rigid reinforcing unit forms a bent portion between the first surface and the second surface (at the peak ridge line), and forms a downward curve and presents a saddle shape at the peak ridge line, and the rigid reinforcing units of the diaphragm structure can solve the stress concentration problem between the first surface and the second surface (at the peak ridge line) so as to improve the strength of the rigid reinforcing units and enhance vibration energy of the diaphragm, thereby effectively improving sensitivity of the loudspeaker and extending a service life of the diaphragm structure.

Although this disclosure has been disclosed above with reference to an embodiment, this disclosure is not intended to be limited to this. Any person skilled in the art may make some variations and modifications without departing from the spirit and scope of this disclosure. Therefore, the protection scope of this disclosure is subject to the scope defined by the claims.

What is claimed is:

1. A diaphragm structure of a loudspeaker comprising:

a surround being annular and having an inner rim and an outer rim; and an annular body disposed on the inner rim of the surround, wherein the annular body is integrally formed by a plurality of rigid reinforcing units arranged in a circle, and each of the rigid reinforcing units comprises:

a first side edge;

a second side edge; and two third side edges connected to the first side edge and the second side edge, wherein the two third side edges are located on opposite sides, and the first side edge and the second side edge are separately located on opposite sides;

wherein the two third side edges are formed by a plurality of first reference points at different height positions, and heights of the first reference points asymmetrically and gradually decrease from the middle towards the first side edge and the second side edge to form a substantially upward curve; a peak ridge line is defined between first reference points at the highest position of the two third side edges located on the opposite sides, and the peak ridge line is formed by a plurality of second reference points at different height positions, and heights of the second reference points symmetrically and gradually increase from the middle towards the two third side edges to form a substantially downward curve;

wherein all first side edges of the plurality of rigid reinforcing units at the same height position form an inner circle of the annular body, and all second side edges at the same height position form an outer circle of the annular body.

2. The diaphragm structure of a loudspeaker according to claim 1, wherein the first reference points at the highest height position of the two third side edges are at the same height position.

3. The diaphragm structure of a loudspeaker according to claim 1, wherein a plurality of normal lines is defined at positions perpendicular to the peak ridge line between the first side edge and the second side edge, and a curvature of each of the third side edges is greater than or equal to a curvature of each of the normal lines.

4. The diaphragm structure of a loudspeaker according to claim 3, wherein the highest positions of the normal lines are intersections of the normal lines and the peak ridge line.

5. The diaphragm structure of a loudspeaker according to claim 4, wherein each of the normal lines is formed by a plurality of third reference points at a plurality of different height positions, a normal line passing the lowest position of the peak ridge line is defined as a reference normal line, and a third reference point at the highest position of the reference normal line is a second reference point at the lowest position of the peak ridge line.

6. The diaphragm structure of a loudspeaker according to claim 1, wherein each of the rigid reinforcing units comprises a first surface and a second surface connected to the first surface; the first surface is between the peak ridge line and the first side edge and between the two third side edges, and the second surface is between the peak ridge line and the second side edge and between the two third side edges, wherein a bent portion is formed between the first surface and the second surface.

7. The diaphragm structure of a loudspeaker according to claim 1, wherein the height position of the second side edge is higher than a height position of the first side edge.

8. The diaphragm structure of a loudspeaker according to claim 1, wherein the material of the annular body is aluminum.

9. The diaphragm structure of a loudspeaker according to claim 8, wherein the aluminum material of the annular body has a density of 2700 $kg/m^3$.

10. The diaphragm structure of a loudspeaker according to claim 8, wherein the aluminum material of the annular body has a Young's modulus of 75 GPa.

11. The diaphragm structure of a loudspeaker according to claim 8, wherein the aluminum material of the annular body has a Poisson's ratio of 0.33.

* * * * *